US006948561B2

(12) United States Patent
Myron

(10) Patent No.: US 6,948,561 B2
(45) Date of Patent: Sep. 27, 2005

(54) INDEXING APPARATUS

(75) Inventor: Walter J. Myron, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 227 days.

(21) Appl. No.: 10/194,129

(22) Filed: Jul. 12, 2002

(65) Prior Publication Data

US 2004/0007356 A1 Jan. 15, 2004

(51) Int. Cl.[7] ..... E21B 34/14

(52) U.S. Cl. ..... 166/240; 166/320; 166/386; 166/334.4; 251/205

(58) Field of Search ..... 166/237, 240, 166/320, 386, 331, 332.1, 332.2, 334.1, 334.4; 251/205

(56) References Cited

U.S. PATENT DOCUMENTS

| | | | | |
|---|---|---|---|---|
| 3,446,280 A | * | 5/1969 | Nutter | 166/152 |
| 3,831,677 A | * | 8/1974 | Mullins | 166/128 |
| 4,101,157 A | | 7/1978 | Richey | |
| 4,273,190 A | * | 6/1981 | Baker et al. | 166/278 |
| 4,364,430 A | * | 12/1982 | Szarka | 166/214 |
| 4,403,659 A | | 9/1983 | Upchurch | |
| 4,697,638 A | * | 10/1987 | Knight | 166/65.1 |
| 5,024,272 A | * | 6/1991 | Roessler | 166/117.7 |
| 5,529,126 A | | 6/1996 | Edwards | |
| 5,584,342 A | | 12/1996 | Swinford | |
| 5,609,178 A | | 3/1997 | Hennig et al. | |
| 5,743,331 A | | 4/1998 | Adkins et al. | |
| 5,826,661 A | | 10/1998 | Parker et al. | |
| 5,947,205 A | | 9/1999 | Shy | |
| 6,095,249 A | | 8/2000 | McGarian et al. | |
| 6,109,354 A | | 8/2000 | Ringgenberg et al. | |
| 6,119,783 A | | 9/2000 | Parker et al. | |
| 6,152,228 A | | 11/2000 | Carmichael | |
| 6,276,458 B1 | | 8/2001 | Malone et al. | |
| 6,352,119 B1 | | 3/2002 | Patel | |
| 6,371,208 B1 | | 4/2002 | Norman et al. | |

FOREIGN PATENT DOCUMENTS

| | | |
|---|---|---|
| GB | 2362399 A | 11/2001 |
| GB | 2377234 A | 1/2003 |

OTHER PUBLICATIONS

Schlumberger, Information regarding "TRFC–H Hydraulic Tubing Retrievable Flow Controller", 2 pages, date unknown.

* cited by examiner

*Primary Examiner*—David Bagnell
*Assistant Examiner*—K. Thompson
(74) *Attorney, Agent, or Firm*—Steve Rosenblatt

(57) ABSTRACT

An indexing mechanism is disclosed that can put a tool in a variety of positions while downhole in the face of high static and dynamic loads. In the preferred application, the mechanism controls a movable sleeve on a downhole choke. It contains an indexing feature comprising a pin movable in a series of slots. A piston restrained to move longitudinally engages and rotates an index sleeve to allow the pin to advance into the next J-slot track. A separate lug on the piston engages a radial face on the index sleeve to take the shock load and position the choke instead of allowing the pin to load against the closed end of the slot.

20 Claims, 4 Drawing Sheets

INDEXING APPARATUS

FIELD OF THE INVENTION

The field of the invention is positioning systems generally and specifically applied to downhole adjustable chokes.

BACKGROUND OF THE INVENTION

Sliding Sleeves have been used in downhole well completions for many years for controlling the flow of wells. These sleeves normally only have two positions, they are either fully open or fully closed and are not adjustable between these two extreme positions. These sleeves have evolved over time from requiring costly manual intervention to remotely operated. The next evolution of these sleeves requires that the flow area of these sleeves to be adjustable. These tools are now generically regarded as downhole chokes. Having the ability to adjust the flow area means that the operators can control the flow of fluids and gasses to and from the reservoir. The primary reason for this requirement is to maximize the efficiency of hydrocarbon recovery from the reservoir and minimize the risks and costs of producing these hydrocarbons.

The indexing mechanism to position the choke valve body in various positions could be subjected to very high forces above those initially envisioned if due to exposure to well fluids and conditions over a period of time the moving parts become much harder to move. Many times the use of available hydraulic pressure at the well head is used with a built in margin to be able to move the moving parts even against resistance caused by binding or particles in the path making the needed movements much more difficult. These designs tend to overpower the moving parts during normal operation in the early goings, when there is not as much resistance to movement between or among the moving parts. These very high forces can cause failure of the parts resulting in a loss in the ability to manipulate the choke into the desired positions.

In the past devices have been created to covert axial motion to rotational motion downhole. This tool was complex, involving a toothed ratchet interacting with a helix on an elongated member. It is illustrated in U.S. Pat. No. 5,584,342. This device was applied to cleaning debris out of pipe. More specific to operation of chokes requiring several positions are U.S. Pat. Nos. 5,826,661 and 6,119,783, which use a sequential application and removal of pressure in conjunctions with slips that allow movement in predetermined amounts, each time the pressure is cycled on and off. This design involved complicated movements and small spring loaded parts that would have been of marginal utility in dealing with large differential pressures which could cause parts to slam together in a manner that could break them or make them stick. Other designs addressed the configuration of the stationary and movable ports, as illustrated in U.S. Pat. No. 6,371,208. The commercial embodiment of this particular design employed a stepper motor operating a rack and pinion to achieve infinitely variable positions for a downhole choke. This system is very complex and expensive to manufacture and operate. Finally, J-slots have long been used in various downhole tools. In a J-slot the pin advances in a slotted track and comes to rest at the closed ends of individual slots so that the relative positions of the two bodies could be determined. The nature of prior art J-slots limited their application to light duty where there was no likelihood of the pin slamming into the end of the slot with great force where is could be damaged or sheared off. A tubing retrievable flow controller model TRFC-H made by Schlumberger uses an indexing system dependent on the location of a ratchet pin and an indexer pin to define multiple positions of a downhole choke.

What is needed is a design that involves simplicity while being able to tolerate large loads caused by high differential pressure applications and the high impact necessarily involved in such operations. The present invention accommodates such severe service by separation of the shifting mechanism from the ultimate positioning mechanism. These and other advantages of the present invention will be more readily understood by those skilled in the art from a review of the description of the preferred embodiment and the claims, which appear below.

SUMMARY OF THE INVENTION

An indexing mechanism is disclosed that can put a tool in a variety of positions while downhole in the face of high loads. In the preferred application, the mechanism controls a movable sleeve on a downhole choke. It contains an indexing feature comprising a pin movable in a series of slots. A piston restrained to move longitudinally engages and rotates an index sleeve to allow the pin to advance into the next J-slot track. A separate lug on the piston engages a radial face on the index sleeve to take the large loads and position the choke instead of allowing the pin to load against the closed end of the slot.

DETAILED DESCRIPTION OF THE PREFERRED EMBODIMENT

Figure 1:
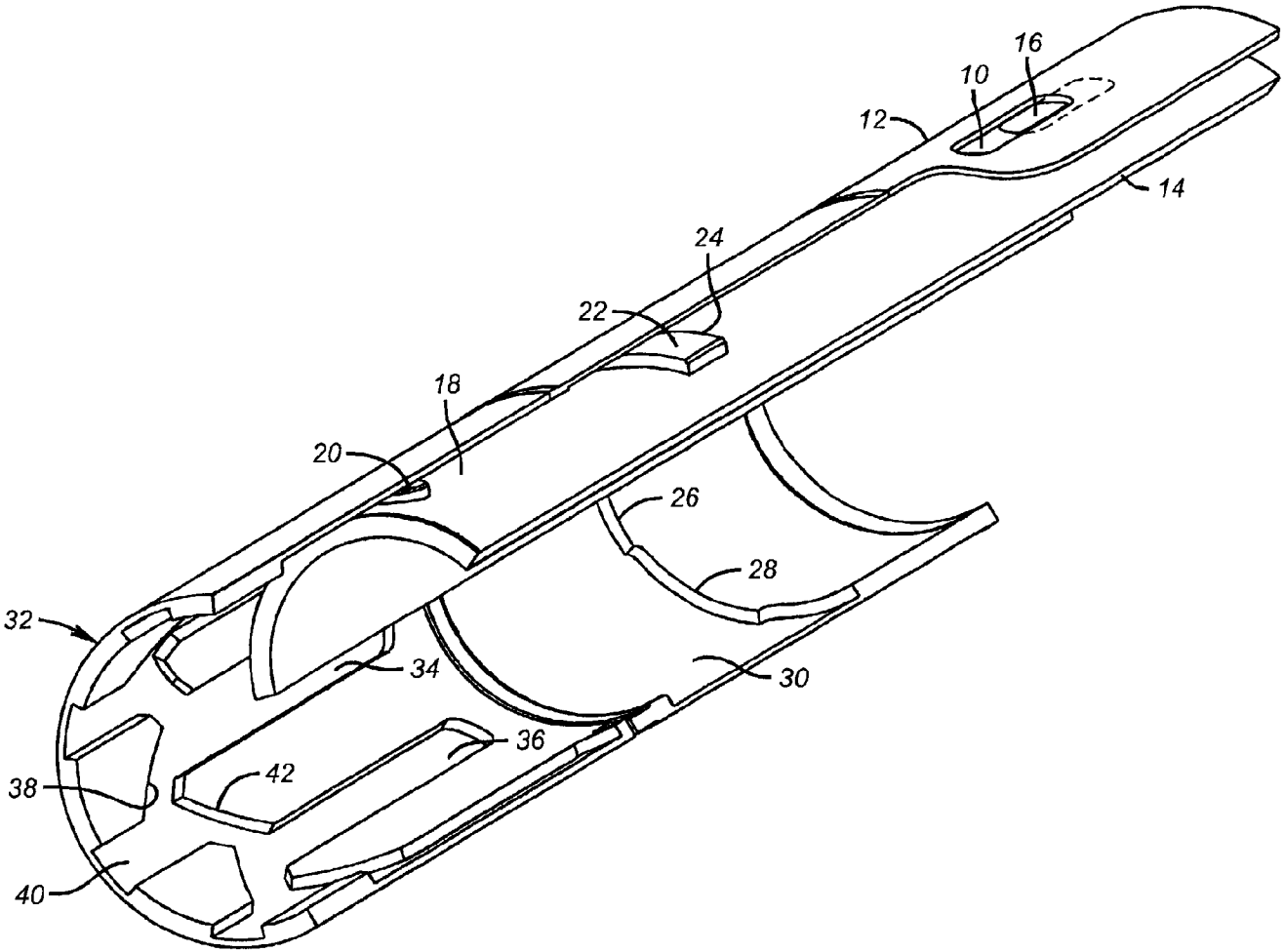
FIG. 1 is a cutaway perspective view of the indexing mechanism in a first position.
Figure 2:
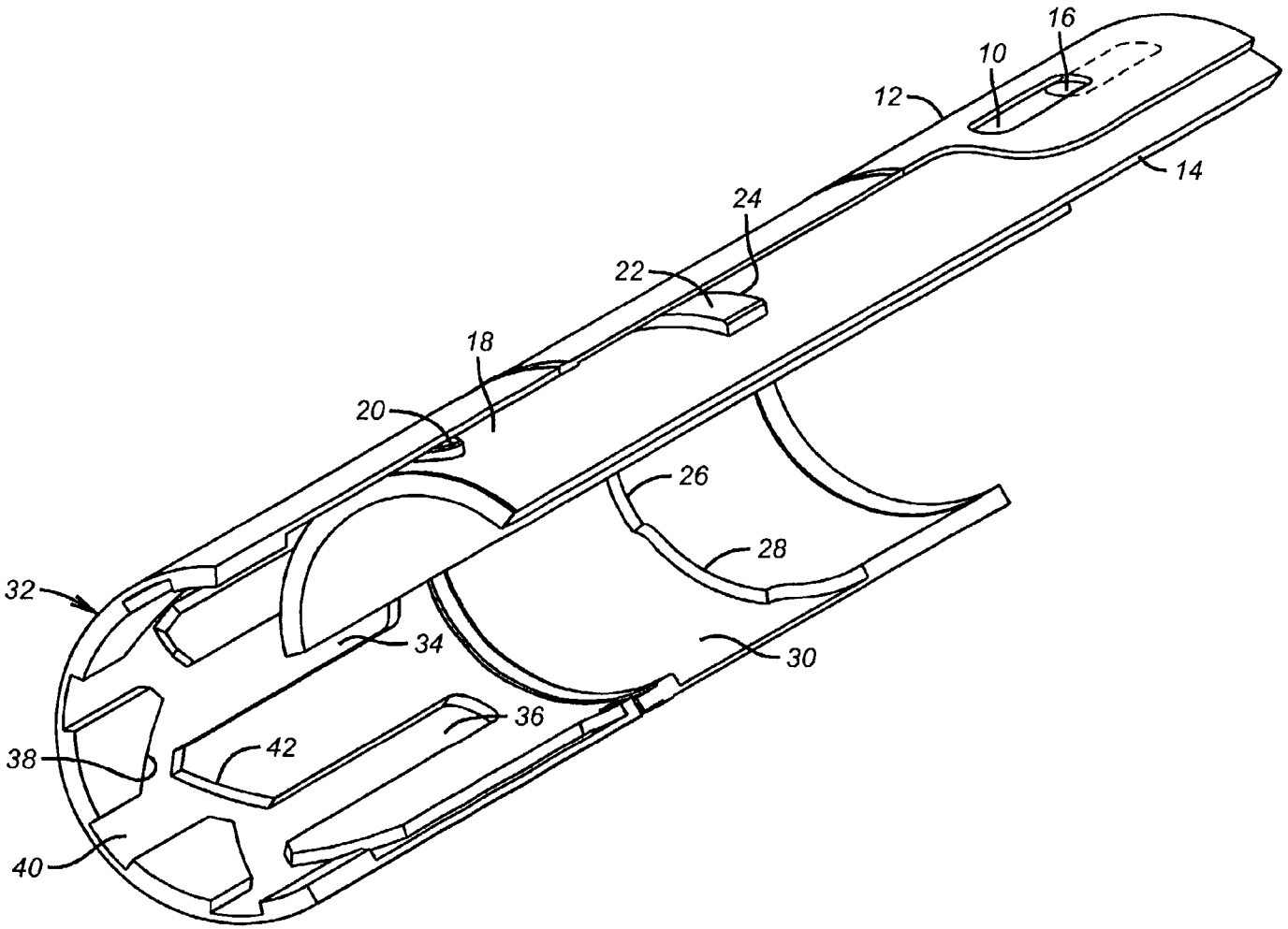
FIG. 2 is the view of FIG. 1 with the indexing mechanism in a second position showing a greater overlap between the movable and stationary apertures.

Those skilled in the art will appreciate that an adjustable choke works by relative movement between movable and fixed apertures so that the orifice size for the throttling function is varied. A greater overlap means an enlarged flow area and a lower pressure drop across the choke. The openings 10, one of which is shown in FIG. 1, that are fixed are generally disposed on a sleeve 12. Sleeve 12 is fixedly mounted in a housing, 17, to which the inlet and outlet flows are connected. Mounted adjacent the sleeve 12 and preferably concentrically therewith is a piston 14 having a series of movable openings 16, one of which is shown in FIG. 1. Piston 14 can be driven mechanically or hydraulically and can be biased toward urging contact between lug 22 and a corresponding circumferential shoulder surface such as 26 or 28. In the position of FIG. 1 openings 16 have moved into a partial overlapping position with openings 10 with the dashed lines indicating the level of misalignment between the movable and stationary openings.

The piston 14 is a tubular structure that is constrained to move only longitudinally. On its outer surface 18 it has a pin 20 and a lug 22. In the preferred embodiment, the pin 20 is aligned longitudinally with lug 22 although such alignment is not mandatory. The shape of lug 22 can be varied although it is preferred that it have a long dimension 24 for contact with circumferential shoulder surfaces such as 26 and 28 located on the inside surface 30 of the index sleeve 32. Other shapes for the travel stop than a circumferential shoulder are also contemplated. Index sleeve 32 is preferably mounted over piston 14 such that pin 20 is initially disposed in one of a plurality of parallel tracks of which tracks 34 and 36 are shown in FIG. 1. The index sleeve is retained so that it can rotate about its central axis but it cannot translate. When the piston 14 is moved by any one of a variety of different motive forces, it translates moving the pin 20 in a given slot, such as 34, for example. Eventually, the pin 20 engages tapered surface 38 on index sleeve 32. Since the piston 14 is constrained against rotation about its central axis, the index sleeve 32 which can rotate does so as the pin 20 enters slot 40. Thereafter, when the piston 14 is urged to move in the opposite direction, pin 20 now engages sloping surface 42 between slots 34 and 36 to force the index sleeve to rotate in the same direction as before to put slot 36 in alignment with pin 20. As a result of rotations of the index sleeve 32, circumferential shoulder surface 28 has rotated into alignment with long dimension 24 of lug 22. Since surface 28 is higher than surface 26, the piston 14 can travel further up before surface 24 engages thus reducing the overlap between openings 10 and 16. The position is determined by the engagement of the lug 22 with the surface 28 or others like it that are distributed in a circular fashion in such a manner that stoking the piston 14 back and forth enough times will allow the choke to go from fully closed to fully open and back again in the number of increments determined by the number of slots such as 34 or 36 and the actual positions will be determined by the placement of the circumferential shoulder surfaces such as 26 and 28. The travel stop that takes the shock of each intermediate position is the lug 22 hitting a counterpart shoulder surface and not the pin 20 engaging a closed end of a slot such as 34. Unlike a typical J-slot of past designs, the height of the individual slots becomes immaterial to the final placement of the parts with respect to each other. As shown in the rolled out interior view of FIG. 3A, the slot peaks 44 are identical in height but are not required to be. This is because it is the engagement of lug 22 with a respective shoulder such as 28 on the index sleeve 32 precludes the pin from loading against slot peak 44 or even from contacting it at all, depending on the layout of the parts. In essence, the pin and slot serves the purpose of altering alignment between the lug 22 and the next shoulder in line such as 28. When they contact, taking up the load, the new position of the choke is defined. The large load is not taken up on the pin 20 colliding with a slot peak 44. This layout allows the choke to close incrementally and then to open incrementally. The increments can be of equal proportions or they can be different.

Those skilled in the art will appreciate that the indexing mechanism is simple and reliable, using a mechanism to turn translation into rotation. Other mechanisms than a J-slot are contemplated to turn translation into rotation as long as the intermediate positions are determined by another mechanism that is beefy enough to take the large load of each intermediate position. In the preferred embodiment, the J-slot is used for repositioning a separate lug 22 against a series of shoulders, such as 28, while the pin 20 avoids the shock of collision with a slot peak 44.

While the preferred application is for a downhole choke, other tools can employ the present invention. The mechanism can move sliding sleeves or any other valves whether used on the surface or downhole. It can be used to operate downhole locks, or as a release device on a running tool or any number of tools that would benefit from the incremental movements as explained and more particularly where the loads are significant and the indexing mechanism needs to be less rugged yet reliable in operation. Large shock loads and large loads caused by differentials in pressure of over 10,000 PSI are contemplated.

The placement of the pin 20 and the slots such as 34 and 36 can be transposed so that the pin 20 is on the index sleeve 32 that is constrained to translate while the piston 14 is allowed to rotate. The lug 22 can be on the index sleeve 32 and the travel stops can be on the outer surface of the piston 14. The openings 16 could then be on the index sleeve 32.

Figure 3:
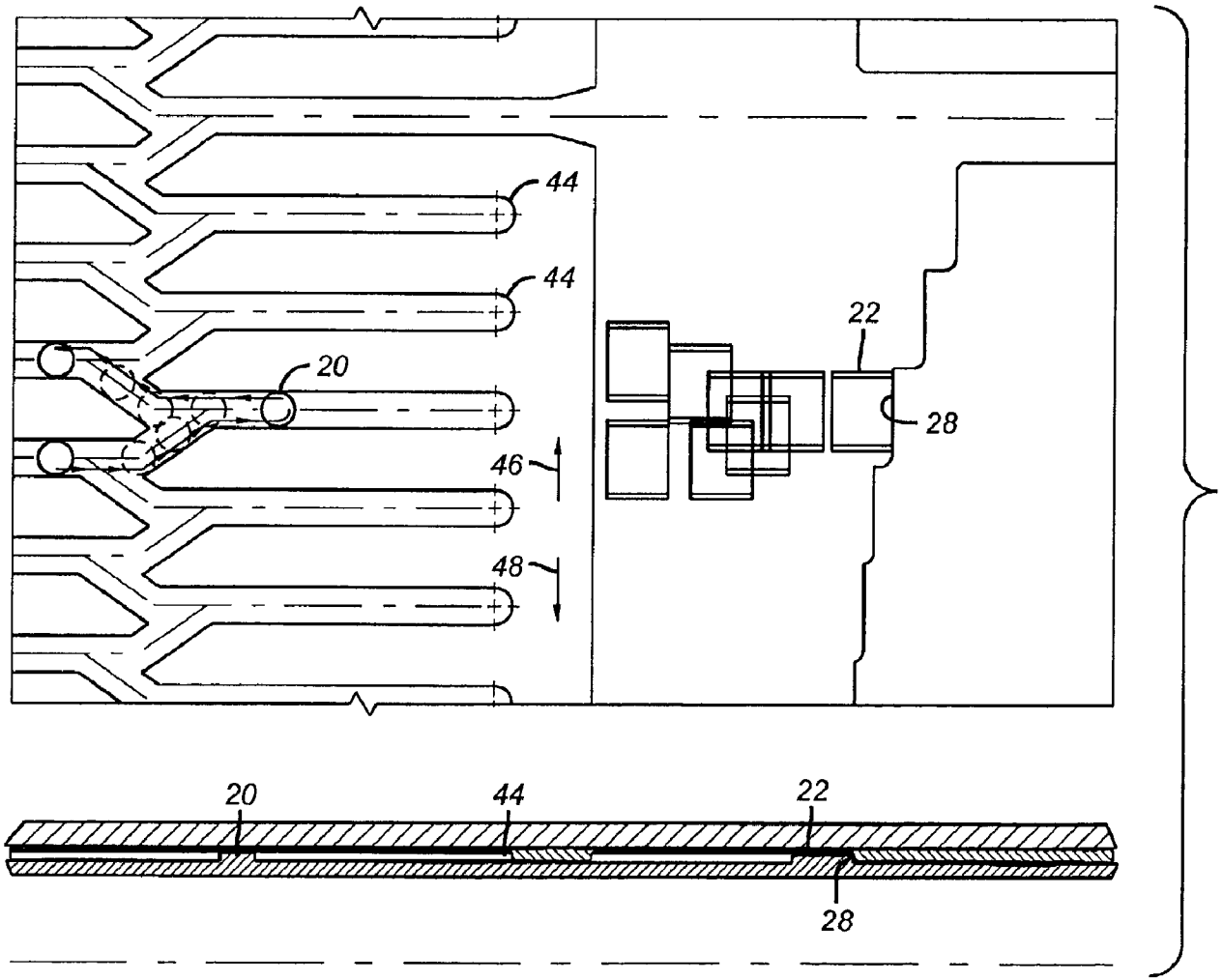
FIG. 3A is a rolled out interior view of the apparatus and FIG. 3B is a section view of the apparatus.
Figure 4:
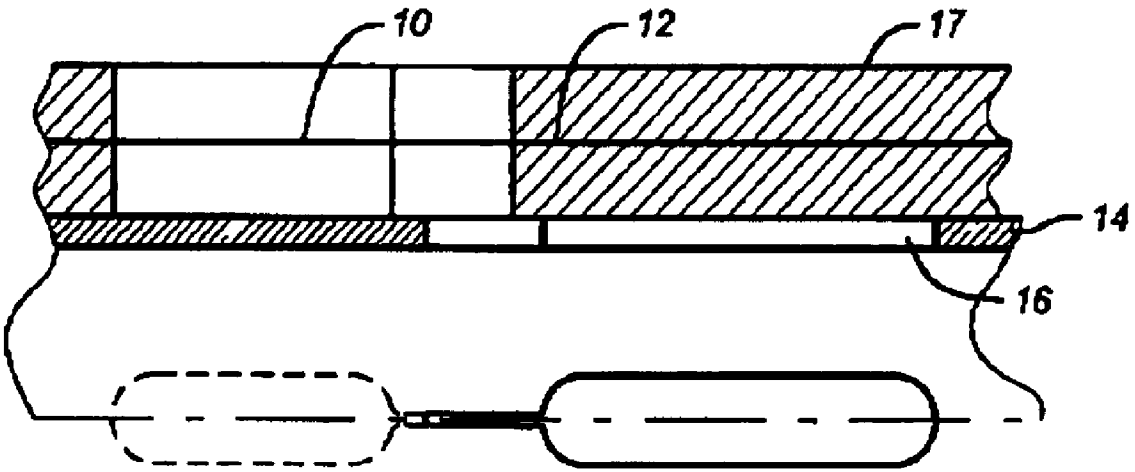
FIG. 4 is a section view showing the operation of the choke using a series of fixed and movable overlapping openings.

The movement of pin 20 in FIG. 3A is consistent with a rotational bias on index sleeve 32 shown schematically by arrow 48. This bias can be reversed as indicated schematically by arrow 46. The direction of the bias can be manipulated from the surface and will control whether the openings 10 and 16 are moving incrementally toward alignment or misalignment. That way a choke that is half open does not need to be moved to fully open before it can close. The same reciprocal motion of the piston 14 can allow the choke to move toward open or closed as determined from the surface.

The foregoing disclosure and description of the invention are illustrative and explanatory thereof, and various changes in the size, shape and materials, as well as in the details of the illustrated construction, may be made without departing from the spirit of the invention.

I claim:

1. A multi-position device for a tool, comprising:

a sleeve having a longitudinal axis;

a piston, said piston operably connected to said sleeve through an indexing member to relatively rotate said piston and said sleeve;

said piston and sleeve further comprising one of a lug and a plurality of travel stops longitudinally spaced from said indexing member for selective load bearing contact in a plurality of longitudinally spaced positions between said piston and said sleeve.

2. The tool of claim 1, wherein:

one of said piston and said sleeve is constrained to translation and the other is constrained to rotation.

3. The tool of claim 1, wherein:

said indexing member is precluded from loading by earlier engagement of said lug to one of said alternate travel stops.

4. The tool of claim 1, wherein:

said indexing member comprises a J-slot assembly.

5. The tool of claim 1, wherein:

said lug is capable of absorbing impacts when striking a travel stop created by differential pressures of over 10,000 PSI.

6. The tool of claim 1, wherein:

said lug is generally rectangularly shaped and said travel stops comprise a series of shoulders in a stair step arrangement.

7. A multi-position device for a tool, comprising:

a sleeve having a longitudinal axis;

a piston, said piston operably connected to said sleeve through an indexing member to relatively rotate said piston and said sleeve;

said piston and sleeve further comprising one of a lug and a plurality of travel stops longitudinally spaced from said indexing member for selective load bearing contact in a plurality of longitudinally spaced positions between said piston and said sleeve;

said indexing member comprises a J-slot assembly;

said J-slot assembly comprises a pin movable in a series of connected slots and wherein an end in each of said slots does not define the final position of said pin in that slot.

8. The tool of claim 7, wherein:

said lug engaging one of said travel stops prevents said pin from engaging an end of a respective slot.

9. The tool of claim 8, wherein:

said pin is constrained to translate while said connected slots are constrained to rotate.

10. The tool of claim 9, wherein:

said slots comprise intermediate sloping surfaces such that when contacted by said pin that is constrained to translate results in a rotational movement of said slots that are constrained to rotate.

11. The tool of claim 9, wherein:

rotation of said slots causes the alignment of a different travel stop with sand lug.

12. The tool of claim 11, further comprising:

a housing mounted around said sleeve;

a fluid inlet and outlet in said housing;

one of said piston and said sleeve further comprising an opening capable of movement toward alignment and misalignment with one of said fluid inlet and outlet in said housing determined by which travel stop is engaged by said lug.

13. The tool of claim 12, wherein:

said lug and said opening are on said piston and said slots and said travel stops are on said sleeve.

14. The tool of claim 12, wherein:

said lug and said opening are on said sleeve and said slots and said travel stops are on said piston.

15. The tool of claim 12, wherein:

said opening is moved into alignment and then misalignment from one of said fluid inlet and outlet in incremental steps defined by engagement of said lug to the next travel stop in sequence in either direction.

16. The tool of claim 15, wherein:

said opening is moved into alignment and then misalignment from one of said fluid inlet and outlet in incremental steps defined by engagement of said lug to the next travel stop in sequence in one direction.

17. The tool of claim 8, wherein:

said lug is generally rectangularly shaped and said travel stops comprise a series of shoulders in a stair step arrangement.

18. The tool of claim 17, wherein:

said sleeve is mounted concentrically over said piston.

19. The tool of claim 18, wherein:

said piston is driven hydraulically.

20. The tool of claim 18, wherein:

said piston is driven mechanically.

* * * * *